US007404554B2

(12) United States Patent
Hendricks et al.

(10) Patent No.: US 7,404,554 B2
(45) Date of Patent: Jul. 29, 2008

(54) METHOD AND APPARATUS FOR MAGAZINE PRESSURE CONTROL

(75) Inventors: Timothy W. Hendricks, Acworth, GA (US); Jeff Disrud, Acworth, GA (US); Frank Moncrief, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 344 days.

(21) Appl. No.: 11/063,264

(22) Filed: Feb. 22, 2005

(65) Prior Publication Data

US 2006/0197272 A1 Sep. 7, 2006

(51) Int. Cl.
*B65H 1/02* (2006.01)

(52) U.S. Cl. ..... 271/149; 271/150

(58) Field of Classification Search ..... 271/148, 271/149, 150

See application file for complete search history.

(56) References Cited

U.S. PATENT DOCUMENTS 3,955,342 A * 5/1976 Johnson et al. ..... 53/377.2
3,966,193 A * 6/1976 Storace et al. ..... 271/150
4,093,207 A 6/1978 Greenwell et al.
4,302,000 A * 11/1981 Frank ..... 271/150
4,323,230 A * 4/1982 Rising ..... 271/12
4,429,864 A 2/1984 Scarpa et al.
4,558,859 A * 12/1985 Duke et al. ..... 271/200
4,582,315 A 4/1986 Scarpa et al.
4,588,180 A * 5/1986 Ballestrazzi et al. ..... 271/5
4,593,895 A * 6/1986 Myers et al. ..... 271/148
4,635,922 A * 1/1987 Roetter et al. ..... 271/119
4,779,860 A * 10/1988 Scarpa ..... 271/110
4,811,939 A * 3/1989 Keith ..... 271/146
4,869,486 A 9/1989 Scarpa et al.
4,884,797 A * 12/1989 Svyatsky ..... 271/126
5,131,899 A * 7/1992 Nagahashi et al. ..... 493/317
5,137,268 A * 8/1992 Suya et al. ..... 271/20
5,244,199 A * 9/1993 Wood ..... 271/150
5,397,214 A * 3/1995 Cheung ..... 414/796.7
5,664,770 A 9/1997 Keller
5,782,735 A * 7/1998 Goodrich et al. ..... 493/338
5,809,741 A * 9/1998 Tovey ..... 53/289
5,934,666 A * 8/1999 Rabindran et al. ..... 271/148
5,971,391 A * 10/1999 Salomon et al. ..... 271/153
6,123,330 A * 9/2000 Schaal ..... 271/31
6,168,372 B1 1/2001 Greenwell
6,199,681 B1 * 3/2001 Ballos, III ..... 198/456
6,203,004 B1 3/2001 Spatafora et al.
6,240,707 B1 6/2001 Ford et al.
6,270,070 B1 * 8/2001 Salomon et al. ..... 271/111
6,311,457 B1 11/2001 May et al.
6,610,954 B2 8/2003 Takizawa (Continued)

*Primary Examiner*—Patrick Mackey
*Assistant Examiner*—Howard Sanders
(74) *Attorney, Agent, or Firm*—Womble Carlyle Sandridge & Rice, PLLC

(57) ABSTRACT

A magazine pressure control is provided with pressure control wheels that are designed to regulate pressure on carton blanks being fed to a folder/gluer in a carton forming operation. These wheels are disposed around the periphery of the carton blank to urge the edges of the cartons forward and to straighten misaligned cartons. A separately controlled motor operates each half of the magazine pressure control. Each motor is controlled by a pressure sensor assembly and regulates the progression of the carton blanks through the magazine pressure control to equalize the pressure around the periphery of the carton blanks as they are presented to the pick face of the folder/gluer.

14 Claims, 3 Drawing Sheets

U.S. PATENT DOCUMENTS 6,619,647 B2 9/2003 Post et al.
6,896,255 B1 * 5/2005 Fick et al. ..... 271/126
2003/0085512 A1 * 5/2003 Middelberg et al. ..... 271/226
2005/0098938 A1 * 5/2005 Hiramitsu et al. ..... 271/65

* cited by examiner

METHOD AND APPARATUS FOR MAGAZINE PRESSURE CONTROL

FIELD OF THE INVENTION

This invention relates to a carton blank feeder that utilizes magazine pressure control to regulate pressure on the pick face of carton forming equipment.

BACKGROUND OF THE INVENTION

Various carton feeding machines have been utilized in the prior art to feed carton blanks in a carton assembly line, such as to a folder/gluer or product packaging machine, to form a blank into a carton. The blanks generally can be fed to the carton folder/gluer manually, by a conveyor, or by chains. Traditionally, the carton stacks are fed manually to the folder/gluer in approximately 2-inch stacks or "slugs." These stacks can impart unequal pressures on the folder/gluer or on carton blanks aligned for feeding into the folder/gluer. Further, the operating speed of the folder/gluer, although capable of higher rates of speed, generally is limited and governed by the stacks in line for processing, as conventional carton feeding apparatuses typically have been unable to regulate the pressure imparted by the weight and/or alignment of more than a 2-inch stack of carton blanks. Such an uneven pressure distribution of the carton blanks in line for the folder/gluer further does not allow the carton feeding apparatus to recover once an edge of the periphery of the carton blank stack proceeds in a crooked alignment. This resulting imbalance presents blanks to the pick face of the folder/gluer unevenly aligned, causing misfeed to the folder/gluer, destruction of the carton blank, or shut down of the entire system.

SUMMARY OF THE INVENTION

Accordingly, one aspect of the invention is to provide a method and apparatus for feeding carton blanks which addresses the foregoing and other related and unrelated problems in the art.

The carton blank feeding system of one embodiment of the present invention generally is designed to automate the feeding of carton blanks to replace manual loading of carton stacks and provide safety, ergonomic, and economic benefits. Further, the magazine pressure control provided by the carton feeding system substantially maintains equal pressure and alignment of the carton blanks for presentation to the pick face of a carton feeding apparatus. Control of the carton blank pressure generally is performed by means of feed chains and pressure control wheels positioned within each of the two halves of the pressure control apparatus, with each half being controlled by a separate pressure sensing switch and motor to regulate pressure around the periphery of the carton blanks as they are fed toward the pick face of a folder/gluer. In this regard, segregating into arrangements other than two halves is also within the scope of the present invention.

Various other objects, features, and advantages of the present invention will become more apparent upon reading the following specification in conjunction with the accompanying drawing figures.

DETAILED DESCRIPTION OF THE INVENTION

The magazine pressure control of the present invention can be used in an assembly line for cartons of the type, for example, which hold cans, bottles or other containers. The carton blanks are fed sequentially to a folder/gluer machine, which forms them into cartons.

Figure 2:
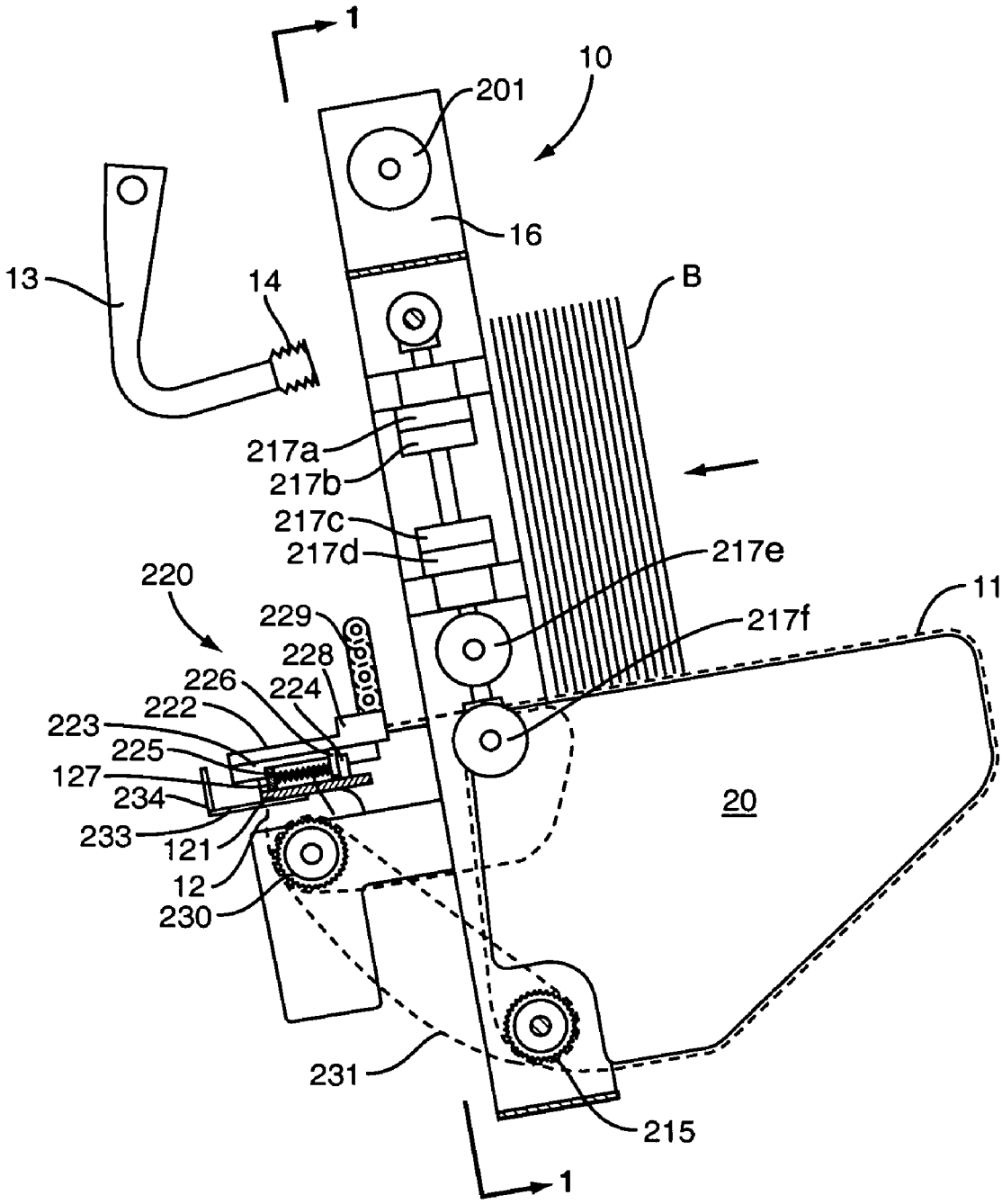
FIG. 2 is a diagrammatic side view of an embodiment of the magazine pressure control apparatus, taken on the line 2-2 of FIG. 1.

The magazine pressure control apparatus 10 in accordance with one embodiment of the present invention may be positioned to receive the carton blanks just before they reach the pick face of a folder/gluer. A stack of carton blanks B is fed toward the pick face of the folder/gluer (not shown) through the magazine pressure control apparatus 10 by overlapping back and front feed chains. As shown in FIG. 2, at the left-hand side of the apparatus back left-hand feed chain 11 passes around left-hand side plate 20, and overlaps front left-hand feed chain 12. In a corresponding arrangement on the right-hand side of the apparatus (not shown in FIG. 2), a back right-hand feed chain passes around a right-hand side plate and overlaps a front right-hand feed chain. At the folder/gluer pick face, each lead blank is picked off the stack in turn by an arm 13 having a vacuum cup 14 at its end and transported thereby to the folder/gluer, as is known in the art.

The magazine pressure control apparatus 10 comprises an outer frame 15 and inner frame 16. The inner frame 16 is attached to the outer frame by clamps 17 or other means so that it can be moved to permit precise alignment with the folder/gluer and allow for variations in the size and orientation of the folder/gluer. The inner frame 16 has an opening in its center through which the carton blanks B are fed.

Figure 1:
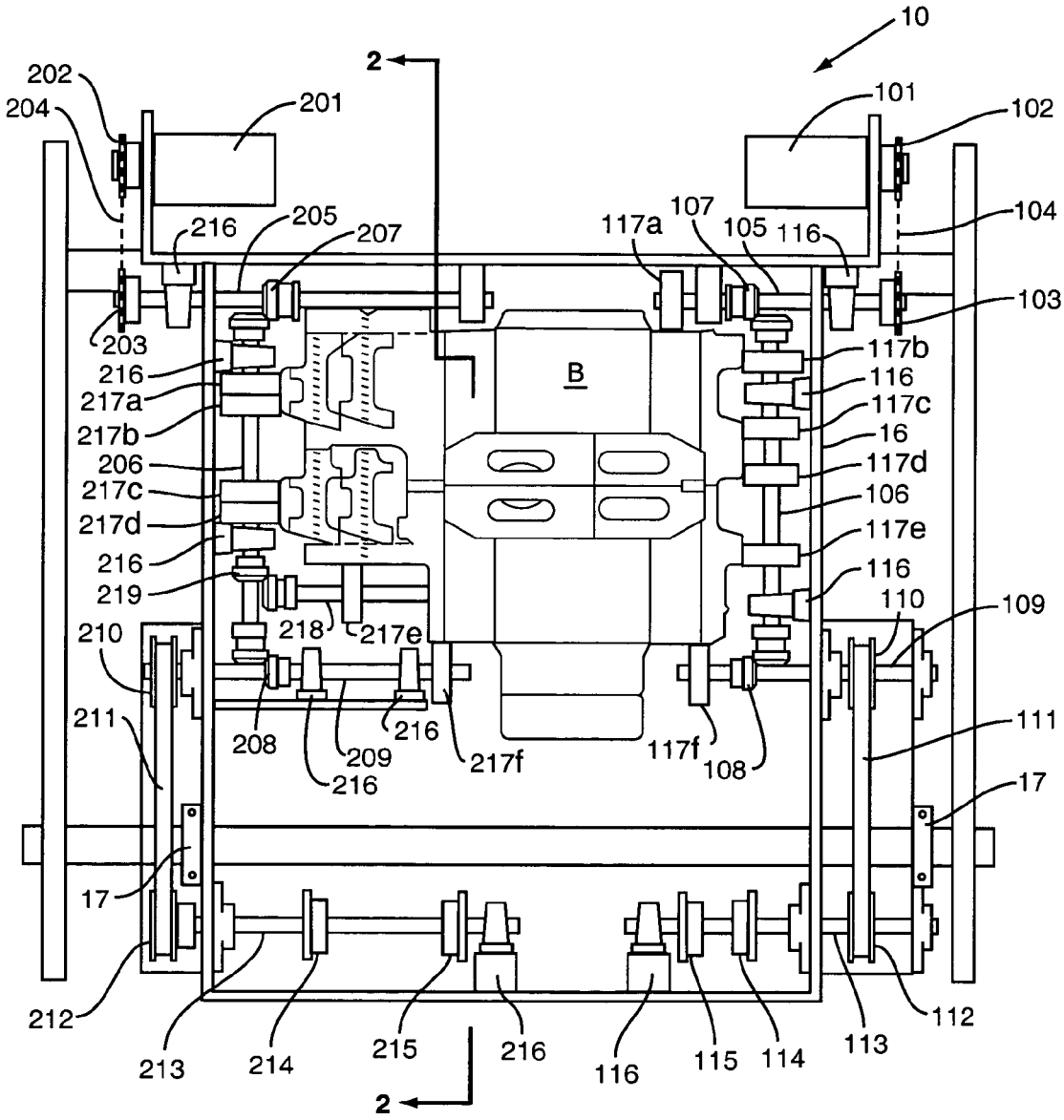
FIG. 1 is a diagrammatic front view of an embodiment of the magazine pressure control apparatus of the present invention, taken on the line 1-1 of FIG. 2.

Motors 101, 201 are disposed on the right and left sides of the inner frame 16. As shown in FIG. 1, these motors are located at the top of the frame, but they could be positioned at any other convenient location on the frame.

Describing first the apparatus at the right-hand side of FIG. 1, a sprocket 102 is carried on the output shaft of motor 101 and drives sprocket 103 via chain 104. Sprocket 103 rotates upper horizontal shaft 105, which in turn rotates vertical shaft 106 via bevel gears 107. At the bottom of shaft 106, bevel gears 108 on vertical shaft 106 engage bevel gears on horizontal shaft 109, which carries a pulley 110 near its outer end. Pulley 110 drives timing belt 111 to cause rotation of pulley 112 and lower horizontal shaft 113 on which pulley 112 is mounted. Mounted on shaft 113 are sprockets 114, 115, which drive the right-hand front feed chain and right-hand back feed chain, respectively. For clarity, the feed chains and side plates are not shown in FIG. 1. It will be understood by those skilled in the art that shafts 105, 106, 109, 113 are mounted for rotation on the inner frame 16 by means of suitable bearings, some of which are shown in FIG. 1 as pillow blocks 116.

Figure 5:
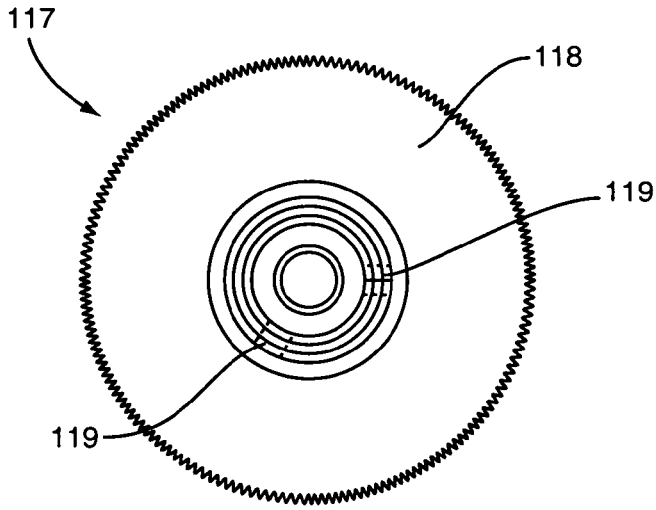
FIG. 5 is an enlarged view of an embodiment of a pressure control wheel used in the magazine pressure control apparatus.

Mounted on shafts 105, 106, 109 are a plurality of pressure control wheels 117*a-f*. As shown in FIG. 5, each of these wheels comprises a disc 118 which is gear-like in appearance, the circumference of the wheel being provided with teeth of such a size and shape as to engage the edges of the carton blanks and feed them toward the pick face of the folder/gluer without tearing or scuffing them. The pressure control wheels in one preferred embodiment are approximately 3 inches in diameter, although it will be understood that wheels of other diameters can be used depending on the size and shape of the carton blanks which are being fed to the folder/gluer. Each pressure control wheel is attached to the shaft on which it is mounted by setscrews 119 or other suitable means, so that it will rotate with the shaft but can be moved to different positions along it, or removed from the shaft as desired.

Instead of a disc 118 with a toothed circumference as shown in FIG. 5, the pressure control wheels may utilize any other arrangement suitable for engaging and imparting movement to the edges of the carton blanks. For example, the circumference of the disc 118 could be knurled, or a rubber ring or tire could be mounted around the periphery of the disc.

The left-hand side of the magazine pressure control apparatus shown in FIG. 1 is similar to the right-hand side. Motor 201 drives upper horizontal shaft 205 via sprockets 202, 203, and chain 204. Vertical shaft 206 is driven through bevel gears 207 and drives horizontal shaft 209 through bevel gears 208. Lower horizontal shaft 213 is driven via pulleys 210, 212 and timing belt 211, and carries sprockets 214, 215 for driving the left front feed chain and left back feed chain respectively. An intermediate horizontal shaft 218 is driven off vertical shaft 206 by bevel gears 219. As on the right-hand side of the apparatus, the various shafts 205, 206, 209, 213, 218 are mounted for rotation on the frame in suitable bearings, some of which are shown as pillow blocks 216.

As shown in FIG. 2, left-hand back feed chain 11, driven by sprocket 215, follows a path around the periphery of left-hand side plate 20. Sprocket 214 drives sprocket 230, mounted on a shaft at the front of frame 16, via chain 231. A sprocket mounted on the same shaft as sprocket 230, and behind sprocket 230 in FIG. 2, engages the left-hand front feed chain 12 and drives it in the path shown in FIG. 2. It can be seen from FIG. 2 that the paths of the front and back feed chains overlap in the vicinity of the opening through frame 16. The right-hand back and front feed chains are similarly driven in corresponding paths by sprockets 114, 115 at the right-hand side of the frame 16 (FIG. 1).

The sizes of the sprockets 114, 115, 214, 215 are preferably chosen so that the back feed chains will run slightly faster than the front feed chains, in order to pull the bottoms of the carton blanks together. This allows any gap remaining between succeeding stacks of blanks to be taken up. The speed of the front feed chains is generally designed to be the same as the circumferential speed of the pressure control wheels 117, 217.

It will thus be seen that activation of right-hand motor 101 causes rotation of the shafts 105, 106, 109 and 113 on the right-hand side of the magazine pressure control apparatus, together with the pressure control wheels 117*a-f* mounted on the shafts and the right-hand feed chains. Likewise, activation of left-hand motor 201 causes rotation of the shafts 205, 206, 209, 213 and 218 on the left-hand side of the magazine pressure control, together with the pressure control wheels 217*a-f* mounted thereon and the left-hand feed chains 11, 12.

Pressure control wheels 217*a-f* are of the same construction as pressure control wheels 117*a-f*.

Figure 3:
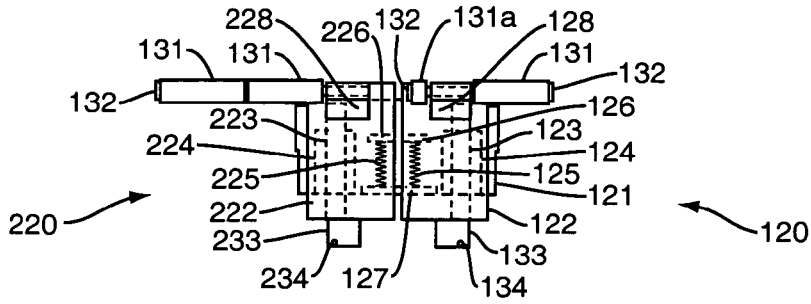
FIG. 3 is a top view of the pressure sensor assemblies of the magazine pressure control apparatus of FIGS. 1 and 2.
Figure 4:
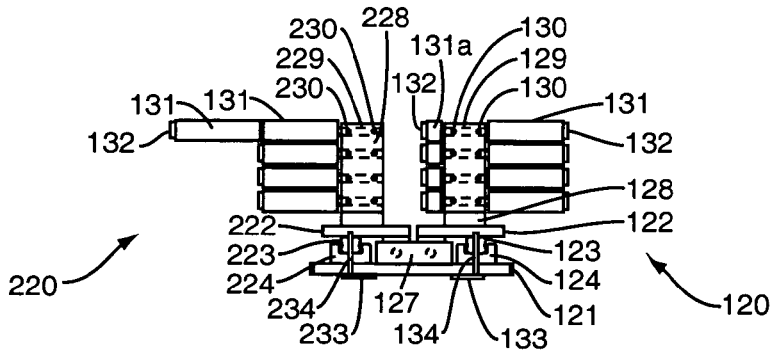
FIG. 4 is a front view of the pressure sensor assemblies of FIG. 3.

As shown in FIGS. 2, 3 and 4, the magazine pressure control apparatus further comprises right-hand and left-hand pressure sensor assemblies 120, 220 (only left-hand assembly 220 is shown in FIG. 2), which are located at the pick face of the folder/gluer, where they will be contacted by the carton blanks B which are being fed toward the pick face by the feed chains 11, 12 and pressure control wheels 117, 217.

Assemblies 120, 220 are mounted on fixed plate 121 attached to the frame 16. Considering first the left-hand assembly 220, a movable plate 222 is slidably mounted relative to fixed plate 121 by means of a rail 223 attached to the bottom of plate 222 which slides in a suitable slide bearing 224. Movable plate 222 is biased away from the pick face by compression spring 225, which acts between a block 226 fixed to the bottom of movable plate 222 and block 127, attached to the upper surface of fixed plate 121. At the edge of the movable plate 222 which is remote from the pick face is fastened an upstanding roller mount 228, provided with horizontal bores 229. Received in bores 229, and releasably fastened therein by setscrews 230, are shafts on which are mounted one or more rollers 131. The rollers are rotatable on the shafts, and are held thereon by clamp collars 132. A plate 233 connected to the bottom of fixed plate 121 carries a proximity switch 234 in position to be engaged by movable plate 222. The switch 234 is connected via suitable circuitry to the left-hand motor 201, such that the motor 201 is actuated when the movable plate 222 is out of engagement with the switch 234, but the power to the motor 201 is cut off when the movable plate moves back against the force of spring 225 to contact the switch 234.

It will be seen from FIG. 3 that the right-hand pressure sensor assembly 120 is aligned transversely of the feed direction with the left-hand assembly 220 and is substantially a mirror image of the left-hand assembly, having a movable plate 122, rail 123, bearing 124, compression spring 125, block 126, roller mount 128 with bores 129 and setscrews 130, plate 133 and proximity switch 134, which is connected by suitable circuitry to right-hand motor 101.

As shown in FIGS. 3 and 4, the shafts in bores 129, 229 may be of different lengths, and may be fixed in different positions relative to the roller mounts 128, 228. This allows the use of different numbers and/or sizes of rollers 131 in various positions on the roller mounts 128, 228, depending upon the configuration of the carton blanks being fed. For example, in the particular arrangement shown in FIGS. 3 and 4, the uppermost shaft in left-hand roller mount 228 is longer than the other shafts in that mount, so that two rollers may be mounted on it. This allows the upper left-hand rollers to contact the blank B across substantially all of its lower left-hand side (see FIG. 1). In the right-hand roller mount 128, the shafts are fixed in the bores 129 so that they protrude on both sides of the mount. This allows short rollers 131*a* to be mounted on the left-hand ends of the shafts, and rollers 131 to be mounted on the right-hand shaft ends, thereby likewise providing more complete contact with the carton blank. Many other roller arrangements are possible, simply by substituting shafts of different lengths and/or rollers of different sizes.

In operation, motors 101, 201 are energized to actuate the left- and right-hand feed chains and rotate the pressure control wheels 117*a-f* and 217*a-f*. The feed chains feed successive stacks of carton blanks B toward the pick face of the folder/gluer. As shown in FIG. 2, the feed direction may be inclined at an angle to the horizontal, typically about 10°. As the carton blanks enter the magazine pressure control 10, their edges are engaged by right-hand and left-hand pressure control wheels 117*a-f* and 217*a-f*. The pressure control wheels are positioned on shafts 105, 106, 109 and 205, 206, 209 so that they will engage the top, bottom and side edges of the carton blanks. For example, as can be seen in FIG. 1, pressure control wheels 117*b-e* are positioned on right-hand shaft 106 in spaced locations to engage the protruding parts on the right-hand edge of blank B, while pressure control wheels 217*a-d* are positioned on shaft 206 in two groups of two, to engage the two protruding parts on the left-hand edge of blank B. Pressure control wheel 117*a* engages the top edge of the blank, and pressure control wheels 117*f*, 217*e*, 217*f* engage the bottom edges of the blank. It will be understood that since the pressure control wheels are attached to the shafts by setscrews 119 or other suitable means they may be moved to different positions on the shafts; also, they can be added to or removed from the shafts. This allows the pressure control wheels to be repositioned on the shafts, if necessary, in order to engage the edges of blanks of other shapes. While the pressure control wheels are shown in FIG. 1 as engaging portions of the top, bottom and both side edges of the carton blanks, a lesser degree of engagement with the periphery of the blanks may be used in some situations.

As the stack of blanks proceeds through the magazine pressure control apparatus 10, the engagement of the rotating pressure control wheels 117, 217 with the edges of the moving carton blanks around their peripheries feeds the blanks forward while at the same time tending to maintain the blanks in alignment and prevent the blanks from bending, so that they will be presented squarely to the pick face of the folder/gluer.

When the lead carton blank contacts the rollers 131 on the pressure sensor assemblies 120, 220, it will push the movable plates 122, 222 back against the force of springs 125, 225. When the pressure exerted by the lead blank reaches a predetermined value which is great enough to push each of the movable plates 122, 222 so far back that they contact switches 134, 234, the power to motors 101, 201 is cut off, stopping the feed chains 11, 12 and pressure control wheels 117, 217.

If the carton blanks are square to the pick face of the folder/gluer the predetermined value of pressure will be exerted equally on the left- and right-hand rollers 131, so that both motors 101, 201 will cut off at the same time, discontinuing all feeding. However, if the lead blank is cocked, so that it is not perpendicular to the feed direction, the motors 101, 201 may not cut off together. For example, considering FIG. 3, if the lead blank is cocked so that its right-hand side exerts more pressure on the right-hand rollers than its left-hand side exerts on the left-hand rollers, the pressure on the right-hand movable plate 122 may reach the predetermined value which is great enough to push the plate 122 back and contact switch 134 to cut off right-hand motor 101 while left-hand motor 201 is still running. When right-hand motor 101 cuts off, the right-hand feed chains 11, 12 and pressure control wheels 117 discontinue feeding the right-hand sides of the blanks forward, but the left-hand feed chains 11, 12 and pressure control wheels 217 will continue to move the left-hand sides of the carton blanks toward the pick face until the pressure on the left-hand movable plate 222 reaches the predetermined value which is great enough to push the plate 222 back far enough to contact the left-hand switch 234 and stop motor 201, discontinuing the feeding of the left-hand sides of the carton blanks. At that point, the pressure on both sides of the blanks will have been equalized, and the blanks will be square to the pick face, so that each lead blank in turn can be readily picked off the stack of blanks by arm 13.

Thus it will be seen that while the magazine pressure control apparatus of the invention feeds the carton blanks toward the pick face of the folder/gluer, it also can differentially feed one side or the other of the blanks in order to equalize the pressure on them and square them to the pick face, which is perpendicular to the feed direction.

As the lead blanks are picked off the front of the stack of blanks, the pressure against rollers 131 gradually decreases until, after a few blanks have been picked off, the pressure decreases to such an extent that the movable blocks 122, 222 will move away from the pick face under the influence of springs 125, 225 until they break contact with switches 134, 234. This will activate motors 101, 201 to feed more blanks toward the pick face, once more pushing the movable plates 122, 222 back toward the pick face, repeating the cycle of deactivation and activation of the motors 101, 201 described above.

As stacks of carton blanks continue to be fed into the apparatus and blanks continue to be picked off by arm 13, the motors 101, 201 cycle on and off as necessary to maintain the supply of blanks at the pick face under the desired predetermined pressure. The cycling of the motors may also involve one motor operating while the other does not, as described above, in order to differentially feed one side or the other of the blanks toward the pick face as may be necessary in order to keep them perpendicular to the feed direction and square to the pick face.

The present carton blank feeding system can maintain a large enough stack of carton blanks to enable operation of packaging and/or folder/gluer machinery downstream of the feeding system at higher rates of speed than conventional carton blank feeders. The present carton feeding system is adapted to receive a succession of stacks of carton blanks which are up to at least approximately 12-18 inches thick, thus enabling significantly faster operation of the folder/gluer or other packaging equipment with an uninterrupted supply of carton blanks.

While a preferred embodiment of the invention has been described above, it is recognized that variations may be made with respect to features and components of the invention. Therefore, while the invention has been disclosed in preferred form only, it will be obvious to those skilled in the art that many additions, deletions, and modifications can be made therein without departing from the spirit and scope of this invention, and that no undue limits should be imposed thereon except as set forth in the following claims.

What is claimed is:

1. Apparatus for regulating pressure exerted by carton blanks being fed toward a pick face of a carton-forming machine, comprising:

at least one first endless conveying device and at least one first pressure control element, wherein the at least one first endless conveying device is configured to engage a bottom edge of a first portion of the carton blanks and the at least one first pressure control element is configured to engage peripheral edges of the first portion of the carton blanks so as to feed the first portion of the carton blanks toward the pick face;

at least one second endless conveying device and at least one second pressure control element, wherein the at least one second endless conveying device is configured to engage a bottom edge of a second portion of the carton blanks and the at least one second pressure control element is configured to engage peripheral edges of the second portion of the carton blanks so as to feed the second portion of the carton blanks toward the pick face, the second portion of the carton blanks being opposite the first portion of the carton blanks;

at least one motor configured to drive the at least one first endless conveying device, the at least one first pressure control element, the at least one second endless conveying device and the at least one second pressure control element;

at least one first pressure sensor assembly located proximate the pick face to be engaged by said first portion of the carton blanks;

at least one second pressure sensor assembly located proximate the pick face to be engaged by said second portion of the carton blanks;

the first pressure sensor assembly being connected to discontinue operation of the first endless conveying device and the first pressure control element when said first portion of the carton blanks exerts a predetermined value of pressure on said first pressure sensor assembly; and the second pressure sensor assembly being connected to discontinue operation of the second endless conveying device and the second pressure control element when said second portion of the carton blanks exerts a predetermined value of pressure on said second pressure sensor assembly.

2. The apparatus of claim 1, wherein:

the at least one first pressure control element includes first wheels; and the at least one second pressure control element includes second wheels.

3. The apparatus of claim 2, wherein each of the first wheels and second wheels has a circumference provided with teeth for engaging the peripheral edges of the carton blanks.

4. The apparatus of claim 1, wherein the at least one motor comprises a first motor and a second motor, the first pressure control element and first endless conveying device being driven by the first motor and the second pressure control element and second endless conveying device being driven by the second motor.

5. The apparatus of claim 4, wherein the first pressure sensor assembly controls power to the first motor, and the second pressure sensor assembly controls power to the second motor.

6. The apparatus of claim 1, wherein:

the at least one first endless conveying device comprises a first feed chain; and the at least one second endless conveying device comprises a second feed chain.

7. The apparatus of claim 1, wherein the at least one first endless conveying device and the at least one second endless conveying device each comprise a front feed chain and a back feed chain, and wherein the back feed chain is configured to run faster than the front feed chain.

8. The apparatus of claim 1, wherein:

the at least one first pressure control element is driven by a first shaft assembly which is driven by the at least one first endless conveying device; and the at least one second pressure control element is driven by a second shaft assembly which is driven by the at least one second endless conveying device.

9. An apparatus for regulating pressure exerted by carton blanks being fed toward a pick face of a carton-forming machine, comprising:

at least one first endless conveying device and at least one first pressure control element, wherein the at least one first endless conveying device and the at least one first pressure control element is configured to engage peripheral edges of the first portion of the carton blanks so as to feed the first portion of the carton blanks toward the pick face;

at least one second endless conveying device and at least one second pressure control element, wherein the at least one second endless conveying device is configured to engage a bottom edge of a second portion of the carton blanks and the at least one second pressure control element is configured to engage peripheral edges of the second portion of the carton blanks so as to feed the second portion of the carton blanks toward the pick face, the second portion of the carton blanks being opposite the first portion of the carton blanks;

a first motor configured to drive the at least one first endless conveying device, the at least one first pressure control element;

a second motor configured to drive the at least one second endless conveying device and the at least one second pressure control element;

at least one first pressure sensor assembly located proximate the pick face to be engaged by said first portion of the carton blanks; and at least one second pressure sensor assembly located proximate the pick face to be engaged by said second portion of the carton blanks, wherein the first pressure sensor assembly comprises a first movable member which engages a first proximity switch to control power to the first motor so as to discontinue operation of the first endless conveying device and the first pressure control element when said first portion of the carton blanks exerts a predetermined value of pressure on said first pressure sensor assembly, and the second pressure sensor assembly comprises a second movable member which engages a second proximity switch to control power to the second motor so as to discontinue operation of the second endless conveying device and the second pressure control element when said second portion of the carton blanks exerts a predetermined value of pressure on said second pressure sensor assembly.

10. The apparatus of claim 9, wherein the first movable member is biased away from engagement with the first proximity switch and the second movable member is biased away from engagement with the second proximity switch.

11. The apparatus of claim 10, wherein the first movable member includes a first part which is contacted by the first portion of the carton blank to move the first movable member towards engagement with the first proximity switch, and the second movable member includes a second part which is contacted by the second portion of the carton blanks to move the second movable member towards engagement with the second proximity switch.

12. The apparatus of claim 11, wherein the first part and the second part each comprise at least one roller.

13. The apparatus of claim 12, wherein the at least one roller is mounted on a shaft which is releasably mounted to a respective one of the first movable member and the second movable member.

14. The apparatus of claim 11, wherein the first part and the second part each comprise a plurality of vertically aligned rollers.

* * * * *